United States Patent [19]

Takeda et al.

[11] Patent Number: 4,825,203

[45] Date of Patent: Apr. 25, 1989

[54] DRIVE CIRCUIT FOR COLOR LIQUID CRYSTAL DISPLAY DEVICE

[75] Inventors: Makoto Takeda, Tenri; Kunihiko Yamamoto, Kitakatsuragi; Nobuaki Matsuhashi, Tenri; Hiroshi Take, Ikoma, all of Japan

[73] Assignee: Sharp Kabushiki Kaisha, Osaka, Japan

[21] Appl. No.: 751,884

[22] Filed: Jul. 5, 1985

[30] Foreign Application Priority Data

Jul. 6, 1984 [JP] Japan ..... 59-140977
Jul. 11, 1984 [JP] Japan ..... 59-145121

[51] Int. Cl.[4] ..... G09G 3/36

[52] U.S. Cl. ..... 340/784; 340/701; 340/702; 340/703; 350/339 F

[58] Field of Search ..... 340/703, 704, 718, 789, 340/800, 803, 805, 811, 784, 701, 702, 719, 765, 814; 350/339 F; 358/56, 59, 230, 241

[56] References Cited

U.S. PATENT DOCUMENTS

| | | | |
|---|---|---|---|
| 3,848,086 | 11/1974 | Ikeda et al. | 340/800 X |
| 3,944,999 | 3/1976 | Moore | 340/703 |
| 4,113,361 | 9/1978 | Nakano | 340/800 X |
| 4,427,978 | 1/1984 | Williams | 340/784 |
| 4,511,926 | 4/1985 | Crossland et al. | 340/784 X |
| 4,556,880 | 12/1985 | Hamada | 340/784 X |
| 4,574,282 | 3/1986 | Crossland et al. | 340/784 |
| 4,600,274 | 7/1986 | Morozumi | 340/784 |
| 4,653,862 | 3/1987 | Morozumi . | |

FOREIGN PATENT DOCUMENTS

| | | | |
|---|---|---|---|
| 2534052 | 4/1984 | France . | |
| 52-60597 | 5/1977 | Japan | 340/703 |
| 2130781 | 6/1984 | United Kingdom . | |
| 2142180 | 1/1985 | United Kingdom | 340/703 |

OTHER PUBLICATIONS

T. Yamazaki et al., Proceedings of the S.I.D., "A Liquid-Crystal TV Display Panel Incorporating Drivers", vol., 23, No. 4, 1982, pp. 223-226.

*Primary Examiner*—John W. Caldwell, Sr.
*Assistant Examiner*—Jeffery A. Brier
*Attorney, Agent, or Firm*—Birch, Stewart, Kolasch & Birch

[57] ABSTRACT

A color liquid crystal display device which comprises picture element electrodes arranged in a matrix that is made up of the intersecting points of row electrodes and column electrodes, a 1st circuit board with switching elements that are connected to these picture element electrodes, a 2nd circuit board with opposing electrodes, a liquid crystal layer that is inserted in between the said 1st and 2nd circuit boards, a color filter with a specific pattern in between the said 1st and 2nd circuit boards, and a column electrode drive circuit that applies voltage corresponding to color arrangement of the color filter and the density of the display to the said column electrode. The column electrode drive circuit includes a sampling circuit which samples the momentary voltage corresponding to the display picture element out of the display signals that are input.

5 Claims, 8 Drawing Sheets

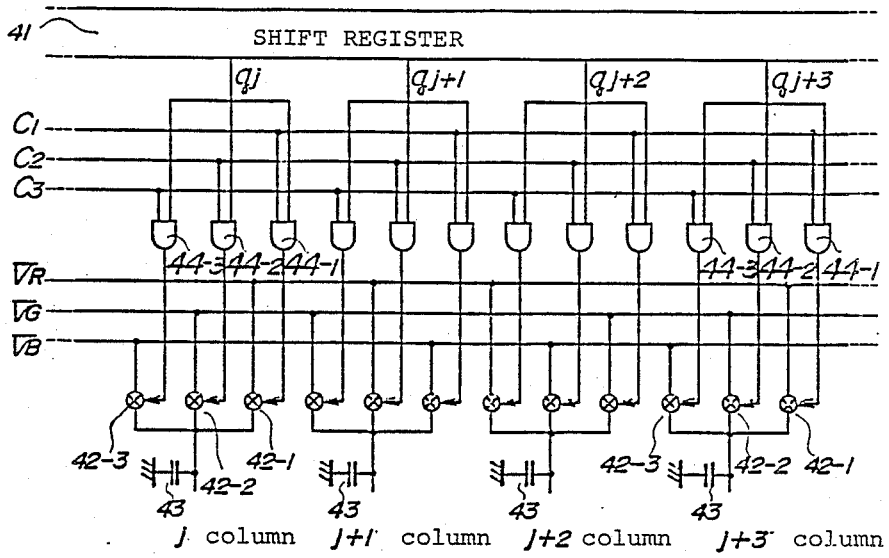
FIG. 4(A)
FIG. 4(B)
| (ROW) | | | | |
|---|---|---|---|---|
| i | R | B | G | R |
| i+1 | G | R | B | G |
| i+2 | B | G | R | B |
| i+3 | R | B | G | R |
| | j | j+1 | j+2 | j+3 (COLUMN) |
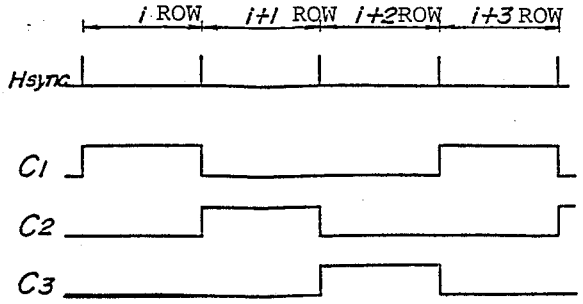
FIG. 4(C)

| (ROW) | | | | | |
|---|---|---|---|---|---|
| i | R | G | B | R | G |
| i+1 | B | R | G | B | R |
| i+2 | R | G | B | R | G |
| i+3 | B | R | G | B | R |
| | j | j+1 | j+2 | j+3 | j+4 (COLUMN) |

DRIVE CIRCUIT FOR COLOR LIQUID CRYSTAL DISPLAY DEVICE

BACKGROUND OF THE INVENTION

This invention concerns a matrix type liquid crystal display device, in particular, a drive circuit for a matrix type color liquid crystal display in which switching transistors and color filters have been added to the respective display elements.

In matrix type liquid crystal display devices such as the one in this in this invention where a switching transistor has been added to each display element, crosstalk which is a problem with normal matrix type liquid crystal display devices is suppressed by the transistor switching mechanism which enables high contrast equivalent to that with static drive even when multiple-line multiplex drive is performed. By adding red, green and blue filters to each of the picture elements of the matrix type liquid crystal display and controlling the amount of light that passes through each filter with the liquid crystal, full color display is possible, and by combining all of the above functions, a liquid crystal display device with very favorable characteristics can be obtained.

When liquid crystal color display devices are driven with the conventional drive circuit, a special switching circuit is provided corresponding to the color arrangement of the color filters in order to switchover colors, which led to a gap between sampling timing and color switching timing. These timing gaps and adjacent display color picture elements mix together which resulted in decreased color definition of the display.

SUMMARY OF THE INVENTION

The objective of the present invention is to solve the above stated problems with the drive circuit for matrix type liquid crystal color display devices and provide a drive circuit for a new and effective liquid crystal display device in which color mixing does not occur due to signal lag, power consumption is low and favorable (high) definition patterns can be obtained.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objectives, the column electrode drive circuit of the color liquid crystal display device in this invention which applies voltage to the column electrode corresponding to the color arrangement of the color filter and the contrast brightness of the display contains a circuit to sample the momentary voltage corresponding to the picture elements to be displayed, out of the display signals that have been input. The said sampling circuit comprises a sampling condensor with one end of the sampling circuit connected to this sampling condensor, and the other ends connected to sampling analog switches which are respectively connected to the red, green and blue display signal lines according to the color arrangement of the said color filter, gate circuits to which color selection signals and display pattern signals are input to output signals to selectively open and close the said sampling analog switches, and a shift register circuit to output the display pattern signals.

Furthermore, to achieve the above objectives, the other sampling circuit in this invention comprises a sampling condensor, with one end of the sampling circuit connected to the said sampling condensor, and the other ends connected to sampling analog switches which are connected to two of the display signal lines (red, green, blue) according to the color arrangement of the said color filter, and gate circuits to which color selection signal and display pattern signals are input in order to output signals to selectively open and close the respective analog switch.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 4 (A), (B), (C) is a diagram showing the configuration of the sampling circuit used in the column electrode drive circuit in the drive circuit of another embodiment of this invention, a color arrangement diagram of the color filter and voltage waveform diagram of the major components;

DETAILED DESCRIPTION OF THE INVENTION

Figure 2:
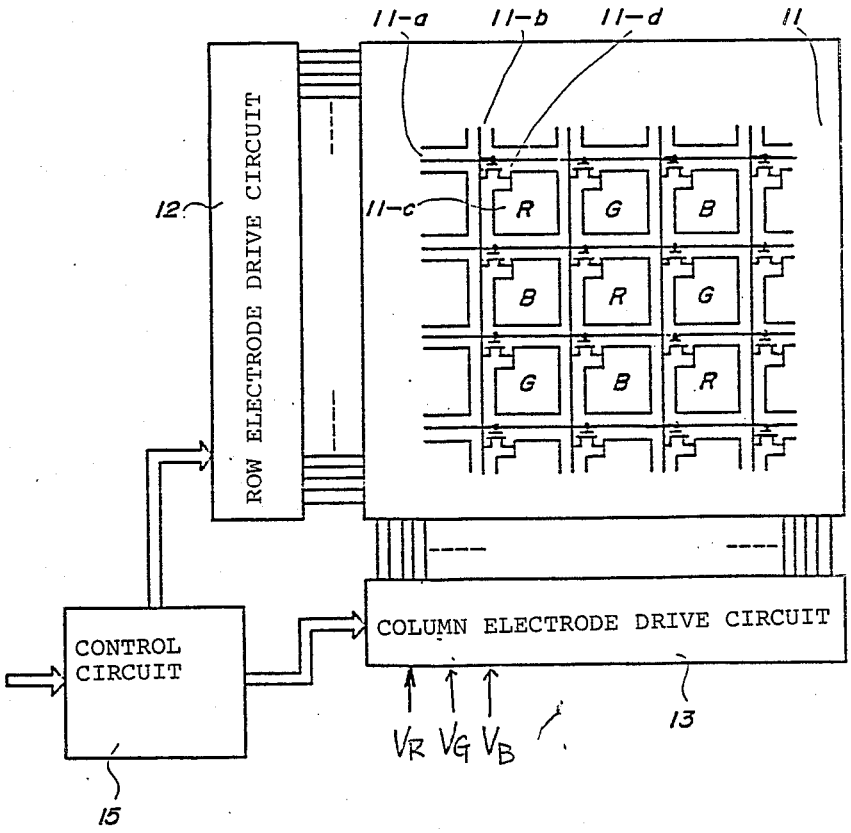
FIG. 2 illustrates the basic configuration of the matrix type color liquid crystal display device with a switching transistor and color filter added.

FIG. 2 is a block diagram which explains a general configuration of the liquid crystal color display device used in this invention. Numeral (11) in the figure is the liquid crystal color display panel. Switching transistors **11-*d* are built into the display picture elements 11-*c*, which are the intersecting points of the row electrodes 11-*a* and column electrodes 11-*b* on one of the circuit boards of the panel (11)**. On the other circuit board, there are counter electrodes, and respective color filters: red (R), green (G ) and blue (B) opposing the display picture elements, arranged, for example, as shown in the diagram.

Numeral (12) is the row electrode drive ciruit which applies a scanning pulse to the row electrode to sequentially select the respective switching transistor.

Numeral (13) is the column electrode drive circuit which applies the display signal that includes the color signal to the column electrode line, synchronized with the scanning pulse applied to the row electrode line.

Numeral (15) is the control circuit which controls the operation of the above circuits. With this liquid crystal display device, the column electrode 11-*b* voltage is applied to the display picture element 11-*c* through transistor 11-*d* for only the row selected by the scanning pulse. Since this causes the transistors 11-*d* that have not been selected to go OFF, the column electrode 11*b* and display picture element 11-*c* are separated, and the voltages of the display picture element(s) 11-*c* are held in the same state, not being affected by the column electrodes 11-*b*, resulting in a display with high contrast in which multiplex drive with a small duty rating can be effected since a voltage equal to the static drive is applied to the liquid crystal layer. Furthermore, since the above column electrode drive circuit (13) applies a voltage corresponding to the color arrangement of the color filter and the density of the display, the intensity of red, green and blue is controlled totally independent of one another for a full color display of good quality.

The basic configuration of the drive circuit which drives the color liquid crystal display device in the embodiment of this invention is apparent from the block diagram in FIG. 2 as explained above, but it will be explained in further detail.

Switching elements, for example, thin film transistors or MOS transistors, are provided on the inner surface of one of the circuit boards that the liquid crystal color display panel is composed of, picture elements to obtain a display pattern are connected to the respective switching elements, and the electrodes are arranged in a matrix.

The switching elements are connected to the row and column electrode lines of the respective intersecting points of the drive electrode lines that are composed of the row electrode lines and column electrode lines that intersect perpendicularly. The other circuit board of the liquid crystal color display panel is provided with counter electrodes opposing the above picture element electrodes and three base color filters: red, green and blue which correspond to the respective picture element electrodes. One color filter for each of the picture element electrodes is provided in between the two circuit boards opposing the respective picture element, and there is an electric field type liquid crystal layer provided in between them which has the same function as a twisted nematic liquid crystal layer.

The amount of light that passes through the liquid crystal layer is changed by the change in the optical characteristics of the liquid crystal layer which responds to the electric field applied in between the picture element electrodes and counter electrodes, synchronized with the on/off operation of the switching elements, in order to execute display of a picture element unit.

The respective picture elements illuminate one of the hue of the three base colors, and by combining 3 picture elements corresponding to the three base colors the hue is determined, to form a full color display pattern on the liquid crystal display panel which consists of 3 individual colors to form 1 picture element unit.

The row electrode lines and the column electrode lines which turn the switching elements on and off are respectively connected to the row electrode drive circuit and column electrode drive circuit. The row electrode drive circuit applies a scanning pulse to the row electrode line as shown in FIG. 3.

Figure 3A:
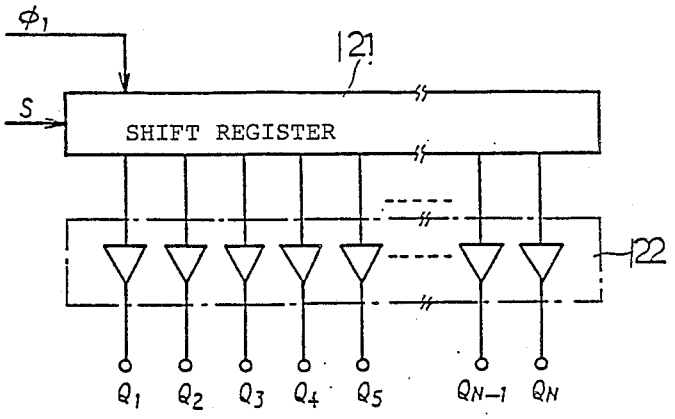
FIGS. 3 (A), (B) are a block circuit diagram of the row electrode drive circuit and a timing waveform diagram illustrating the major voltage waveforms.
Figure 3B:
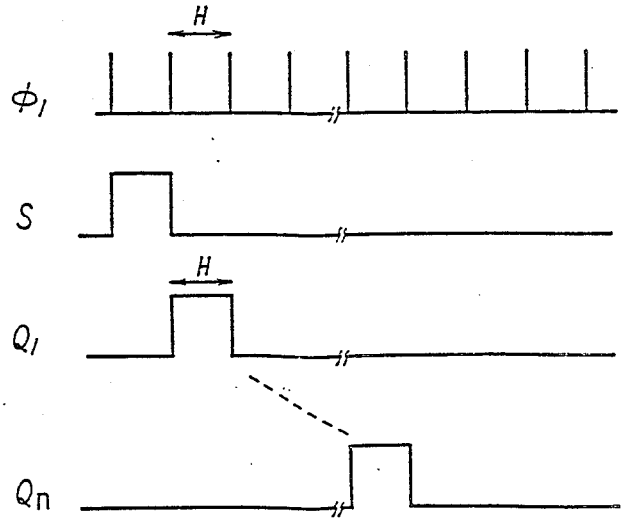

FIG. 3 (A), (B) is a general block circuit configuration diagram of the row electrode drive circuit and timing waveform chart illustrating the major voltage waveforms.

The row electrode drive circuit mainly comprises the shift resistor (121) and buffer circuit (122). The clock ($\phi$1), with the selection period H used as the cycle which corresponds to the drive duty ratio, shifts pulse S to output a sequential scanning pulse to the row electrode through the buffer circuit (122).

Figure 1A:
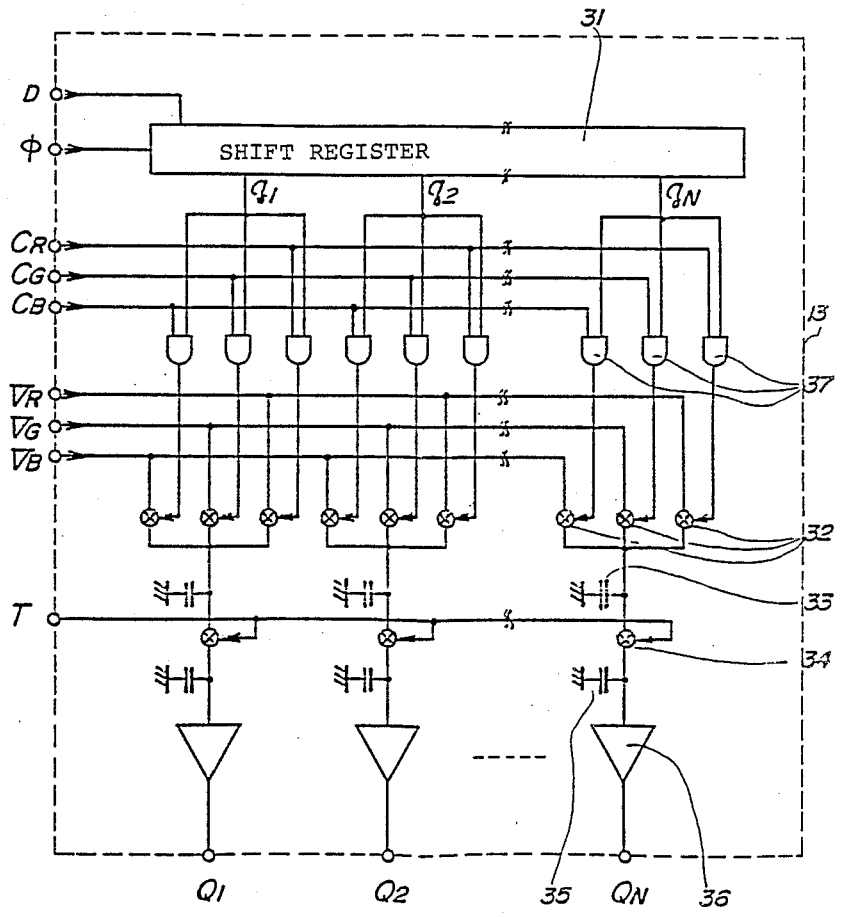
FIGS. 1 (A), (B) explain the configuration of a column electrode drive circuit in a drive circuit for the liquid crystal display device in an embodiment of this invention, and a timing waveform diagram which illustrates the voltage waveforms of the major components of the column drive circuit.
Figure 1B:
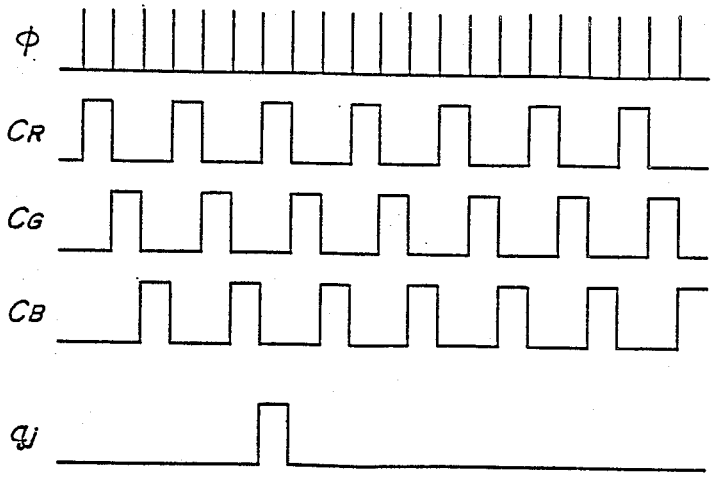

The column electrode drive circuit applies a display signal containing the color signal to the column electrode line, synchronized with the scanning pulse that is applied to the row electrode line, the configuration of which is shown in FIG. 1 (A).

FIG. 1 (A), (B) is a diagram showing the configuration of the column electrode drive circuit (13) in the drive circuit of the liquid crystal display device to explain an embodiment of this invention and a timing waveform chart showing the voltage waveforms of the major components of the column electrode drive circuit (13).

The column electrode drive circuit mainly comprises a shift register (31) which outputs a signal corresponding to the display pattern to each column electrode line, analog switches (32), (34), condensors (33), (35) and an output buffer (36). Three sampling analog switches (32) are respectively connected to the sampling condensors (33), which are each connected to the 3 display signal lines that transmit red, green and blue display signals VR, VG, VB.

The output from the gate circuit (37) connected to the output end of the shift register to changeover color is input to the sampling analog switch (32) to enable selection of one of the three selection signals with the sampling analog switch (32). For this purpose 3 gate circuits (37) are connected as one set in parallel to one of the output ends of the shift register (31), and the output signal from the shift register (31) and one of the 3 selection signals (CR, CG, CG) are input.

The selection signals CR, CG, CB are respectively used to select red, green and blue, and any color arrangement can be obtained by changing the color arrangement with these signals. The selection signal waveforms illustrated in FIG. 1 (B) show the arrangement when when red, green, blue, red, green blue . . . have been selected in this order.

The respective selection signals CR, CG, CB comprise short waveform pulses that are applied sequentially, synchronized with the clock signal $\phi$ input in the shaft register (31). The above circuit configuration inputs the initial data signal D and clock signal $\phi$ to the shift register (31), and the signals required for sequential display are input to the gate circuit (37) from the shift register, synchronized with the clock signal $\phi$ at the output end.

The selection signals CR CG, CB are simultaneously input to the gate circuit (37), therefore the signals output from the gate circuit (37) sample the display signal (VR, VG or VB) corresponding to the column electrode through the sampling analog switch (32), which is stored in the sampling condensor (33).

The sampling signal that is stored is transferred to the hold condensor (capacitance) (35) when sampling is not being done, i.e. when the analog switch (34) is closed, and is output to the respective column electrode lines through the buffer amp (36).

With the above circuit configuration, the color changeover switching circuit which was necessary with conventional devices can be eliminated as well as eliminate the influence of signal delay in the input lines of the display signals. And since changeover of colors is effected in the column electrode drive circuit, color changeover and sampling timing can be easily synchronized by providing an appropriate gate circuit, to completely solve the deterioration of color definition due to mixing of colors in conventional circuits.

FIG. 4 (A) is a circuit diagram of the sampling circuit in the column electrode drive circuit of another embodiment of this invention. The configuration is basically the same as that shown in FIG. 1, but the order of connection of the respective sampling analog switches 42-1, 42-2, 42-3 and the red, green and blue display signals is changed according to the color arrangement patterns in each column, as shown in FIG. 4 (B).

If for example analog switch 42-1 is connected to the display signal lines with column j red, column j+1 blue, column j+2 green and column j+3 red, analog switch 42-2 is likewise respectively connected to the green, red, blue, green display signal lines, and analog switch 42-3 is connected to the blue, green, red and blue display signal lines.

Accordingly, when row i display signals are sampled, by causing C1 only to go to high level out of C1–C3 in the timing waveform diagram, the display signals of column j, red, (j+10) blue, (j+2) green and (j+3) red are sampled, to obtain signals corresponding to the color arrangement of i row,(red, blue, green.)

Likewise, for row (i+1), C2 is caused to go to high level, and for (i+2), C3 is caused to go to high level, to obtain the signals corresponding to the color arrangement shown in FIG. 4 (B).

As explained above, when a particular color pattern is repeated, changeover need only be effected for one each of the control signal C1, C2, C3 rows, enabling frequency of C1–C3 to be considerably reduced in comparison to the embodiment in FIG. 1, which in turn eliminates the effects of signal delay and reduces power consumption (dissipation).

Furthermore, it is apparent from FIG. 4 that changing the order of connection of the sampling analog switch (42) and the red, green and blue display signal lines with the columns is exactly the same as changing the order of connection of other parts, for example the control signals (C1–C3) and gate circuits 44-1–44-3.

As explained above, this invention comprises a drive circuit for a color liquid crystal display device which enables easy switching of colors, which is extremely beneficial in driving a high-capacity high-definition matrix color liquid crystal display device.

Figures 5A, 5B:
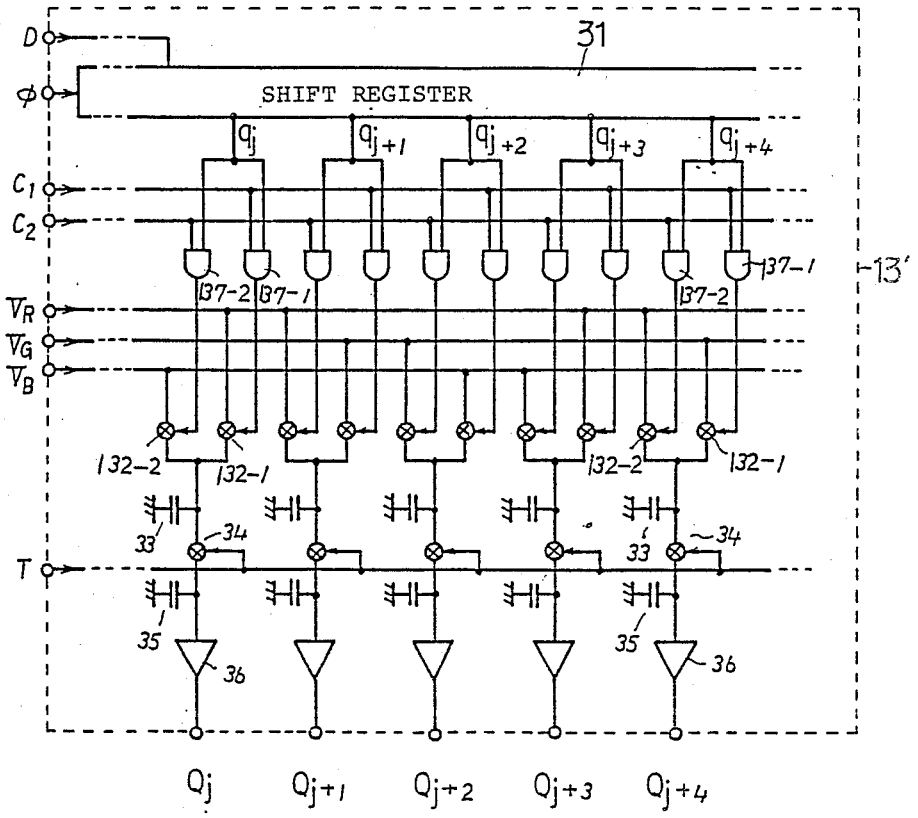
FIGS. 5 (A), (B), (C) are a diagram showing the configuration of the column electrode drive circuit in the drive circuit of the liquid crystal display device in another embodiment of this invention, a color arrangement diagram of the color filter and a timing waveform diagram illustrating the voltage waveforms of the major components.
Figure 5C:
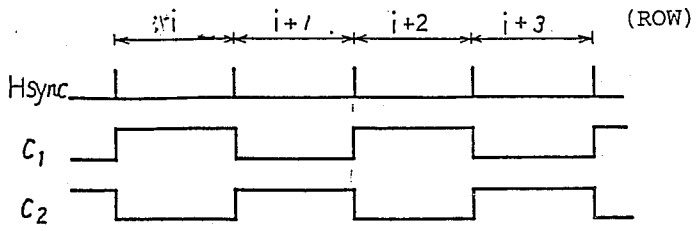

This invention will be further explained using another embodiment shown in FIG. 5 (A), (B), (C). In this embodiment, the internal wiring connection facilitates automatic changeover of color in the horizontal direction, which is effective for color arrangements where two colors (red, green, blue) are provided in one column electrode. The details of this embodiment will be explained as follows.

FIG. 5 (A), (B), (C) is a configuration diagram of the column electrode drive circuit (13') in the drive circuit of the liquid crystal display device, an arrangement diagram illustrating the color arrangement of the color filters and a timing waveform showing the voltage waveforms of the major parts of the column electrode circuit diagram (13') of the other embodiment of this invention.

In FIG. 5 (B), R, G, B indicate the respective red, green and blue color phases, with two filters having two out of the three base colors provided in each column.

The basic configuration of the column electrode drive circuit is the same as for the previous embodiments of this invention, with a shift register (31) that outputs signals to each column electrode line corresponding to the display pattern, analog switches (132), (34), condensors (33), (35) and an output buffer amp (36).

However, two sampling analog switches 132-1, 132-2 are connected to each sampling condensor 33, and these are individually connected to any two of the red, green, blue display signal lines according to the respective column color arrangment.

Two gate circuits (1 set) 137-1, 137-2 are respectively connected to the output end of the shift register (31) in parallel, the output signal from the gate circuit 137 causes one of the sampling analog switches to be sequentially selected to go to the conductive state, and one of the color display signals (VR, VG, VG) is sampled.

The state where the initial data signal D and clock signal $\phi$ are input to the shift register (31), and the display signal of i row of the gate circuit is sampled (sequential output signal), synchronized with the clock signal $\phi$ at the output end.

If C1 of the C1, C2 control signals that are input to the gate circuit 137 goes to high level and C2 goes to low level, one of the gates (137-1) outputs a signal to select one of the sampling analog switches (132-1).

The internal wiring connection then causes red to be sampled for the j column, green for the (j+1) column, blue for the (j+2) column, red for the (j+3) column and green for the (j+4) column, to perform automatic switching of colors in the horizontal direction.

For the (i+1) row, the control signal then causes the switching control signal C1 to go low level and C2 to go to high level according to the horizontal synchronous signal Hsync, to obtain an output signal from the gate circuit (137-2), the sampling analog switch (132-2) is selected, and the blue, red, green, blue, and red display signals are sampled as for the i row.

By repeating these operations, the display signals corresponding to the color arrangement shown in FIG. 5 (B) are sampled. Display signals VR, VG, VB that have been sampled are stored in the sampling condensor (33), and stored signals are transferred to the hold condensor (35) when the analog switch closes (is closed), and are output to the respective column electrodes through the buffer amp (36).

The signals that are applied to the respective column electrodes and scanning pulses applied to the row electrodes control the on/off operation of the switching elements to effect full color display according to the color signals, including intermediate tones.

With the above circuit configuration, the color switching circuit which was necessary with conventional devices can be eliminated, switching of colors in the horizontal direction can be done automatically, with control of switching externally only required in the vertical (column) direction. Switching time is accordingly faster which eliminates the affect of signal delay and reduces power consumption.

As described above, the driving circuit of the present invention is effective to a liquid crystal display device having color filters in the arrangement pattern in which two different color filters are disposed on one column electrode line as shown in FIG. 5(B). But, the driving circuit of the present invention may be applied to a liquid crystal display device having the following color filter arrangement.

Figure 6A:
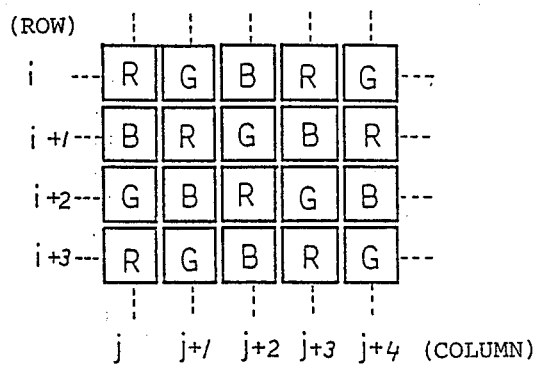
FIGS. 6 (A), (B) is a color arrangement diagram of the color filter in still another embodiment of this invention, and a circuit diagram illustrating the connection of wiring in the liquid crystal panel.
Figure 6B:
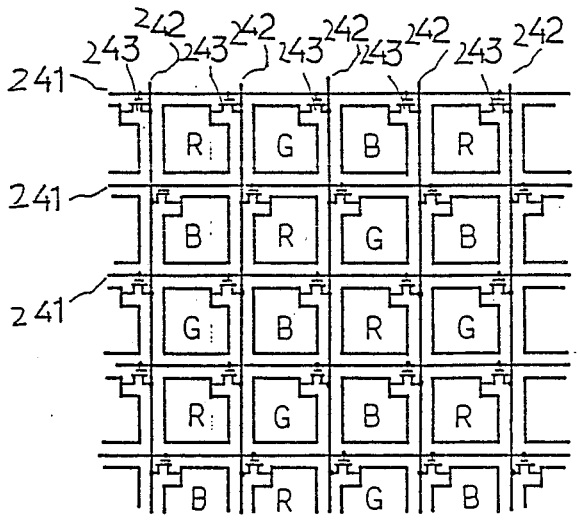

For example, as shown in FIG. 6(A), three different color filters may be disposed on one column electrode line. In this case, in FIG. 6(B), the switching transistors 243 within the single group of R. G. B. colors on the intersection of the row electrode line 231 and the column electrode line 242 are connected alternatively to the right or left display picture elements in connection with the single group of R. G. B. colors against one column electrode line on every row electrode line. Within the single unit of the R. G. B.-color group, the direction of connecting one of R. G. B. color pictures to the switching transistor is alternative. In this arrangement, two different color filters are disposed on each of the column electrodes, so that the driving circuit of the present invention can be applied to the display device having the color filter arrangement of FIG. 6(A). But, the timing of the pulse D which is applied to the sampling shift register 31 must be changed by one-line timing on every row electrode because the column line of the picture element to be displayed against the one column electrode line is different from the position of the row electrode line.

For example, in FIG. 6(A) and (B), if the sampling of the (i+1)-th row electrode line is carried out, the timing of the pulse D must be delayed by one column line in comparison with that of the i-th row electrode line, the (i+2)-th row electrode line, and the (i+3)-th row electrode line.

As described above, the driving circuit of the present invention can provide a easily color-changeable liquid crystal color display device. The present invention may be applied to a matrix type liquid crystal color display device having the high-capacitance and showing high display quality.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A color liquid crystal device comprising:

a first circuit board with multiple row electrodes and multiple column electrodes that intersect to form a matrix of picture element electrodes to which switching elements are connected;

a second circuit board with counter electrodes;

a liquid crystal layer that is inserted in between said first and second circuit boards;

color filters arranged in a selected pattern between the first and second circuit boards, each color filter being one of at least three colors, said selected pattern being an arrangement of said color filters wherein side-by-side color filters are different colors; and column electrode drive circuit means for applying voltage to said column electrode corresponding to the color filter color arrangement and contrast brightness of the color liquid crystal display device;

said column electrode drive circuit means including, at least three analog switches connected to and associated with each column electrode, each analog switch outputting a voltage specific to one of said at least three colors, said voltages outputted by said analog switches being different and each analog switch being associated with one color capable of being displayed in said column such that all said colors displayed by said color liquid crystal display device will be displayed with high color definition and substantially no color mixing, and a sampling circuit that samples momentary, voltage corresponding to display picture elements, from input display signals.

2. A column electrode drive circuit to apply a voltage corresponding to color arrangement of a color filter and contrast brightness of a display to column electrodes of a color liquid crystal display device, comprising:

a sampling circuit to sample momentary, voltage corresponding to display picture elements, out of display signals that are inputted;

said sampling circuit including, a sampling condensor, at least three sampling analog switches for each column electrode, each analog switch having two ends with one of said ends being connected to said sampling condensor and another of said ends of each analog switch being connected to one of at least three display signal lines, each display signal line representing either red, green or blue, said display signal lines being connected to said analog switches according to the color arrangement of said color filters such that each display signal line is connected to one of said analog switches, each analog switch outputting a voltage specific to one of the three colors, said voltages outputted by said analog switches being different and each analog switch being associated with one color capable of being displayed in said column such that all of said three colors displayed by said color liquid crystal display device will be displayed with high color definition and substantially no color mixing, a gate circuit to which color selection signals and display pattern signals are inputted, said gate circuit thereafter outputting signals to selectively open and close said sampling analog switches in response to said color selection signals and said display pattern signals, and a shift register circuit to output said display pattern signals.

3. A column electrode drive circuit to apply voltage according to color arrangement of a color filter and contrast brightness to column electrodes of a color liquid crystal display device, comprising:

a sampling circuit to sample momentary, voltage corresponding to display picture elements, out of display signals that are inputted;

said sampling circuit including, a sampling capacitor, at least two sampling analog switches for each column electrode, each sampling analog switch having two ends with one of said ends being connected to said sampling capacitor and another of said ends of each analog sampling switch being connected to one of three display signal lines, said lines comprising red, green, and blue lines, and said another ends being connected to said display signal lines such that two of said three display signal lines are connected to the color arrangement of said color filter, said sampling analog switches each outputting a different voltage which is specific to said color associated with said sampling analog switch such that all of said colors being displayed in said columns will be displayed with high color definition and substantially no color mixing, a gate circuit to which color selection signals and display pattern signals are inputted, said gate circuit thereafter outputting signals to selectively open and close one of said sampling analog switches in response to said color selection signals and said display pattern signals, and shift register circuit to output said display pattern signals with an output end of said shift register circuit being connected to said gate circuit.

4. A color liquid crystal display device comprising:

a first circuit board with multiple row electrodes and multiple column electrodes that intersect to form a matrix of picture element electrodes to which switching elements are connected;

a second circuit board with counter electrodes;

a liquid crystal layer that is inserted in between said first and second circuit boards;

color filters arranged in a selected pattern between the first and second circuit boards, said color filters being one of at least three colors, said selected pattern being an arrangement of said color filters wherein side-by-side color filters are different colors; and column electrode drive circuit means for applying voltage to said column electrode corresponding to the color filter color arrangement and contrast brightness of the color liquid crystal display device;

said column electrode drive circuit means including, a sampling circuit that samples momentary, voltage corresponding to display picture elements, out of display signals that are inputted, said sampling circuit having two ends, a sampling capacitance being connected to one end of said two ends of said sampling circuit, at least three sampling analog switches for each column electrode, said sampling analog switches being individually connected to one of red, green, or blue display signal lines, each analog switch outputting a voltage specific to one of said three colors, said voltages outputted by said sampling analog switches being different and each analog sampling switch being associated with one color capable of being displayed in said column such that all said colors displayed by said color liquid crystal display device will be displayed with high color definition and substantially no color mixing, each sampling analog switch being connected to another of said ends of said sampling circuit such that each sampling analog switch is individually connected to said sampling circuit;

a gate circuit to which color selection signals and display pattern signals are inputted, said gate circuit thereafter outputting signals that selectively open and close said sampling analog switches; and a shift register circuit to output the display pattern signals.

5. A color liquid crystal display device comprising:

a first circuit board with multiple row electrodes and multiple column electrodes that intersect to form a matrix of picture element electrodes to which switching elements are connected;

a second circuit board with counter electrodes;

a liquid crystal layer that is inserted in between said first and second circuit boards;

color filters arranged in a selected pattern between the first and second circuit boards, said color filters being one of at least three colors, said selected pattern being an arrangment of said color filters wherein side-by-side color filters are different colors; and column electrode drive circuit means for applying voltage to said column electrode corresponding to the color filter arrangement and contrast brightness of the color liquid crystal display device; said column electrode drive circuit means including, a sampling circuit that samples momentary, voltage corresponding to display picture elements, out of display signals that are inputted, said sampling circuit having two ends, a sampling capacitance being connected to one end of said two ends of said sampling circuit, at least two sampling analog switches each of which are connected to another end of said two ends of said sampling circuit, said sampling analog switches being individually connected to one of three display signal lines, said display signal lines comprising red, green, and blue lines, thereby allowing only two of the three display signal lines to be connected to said sampling analog switches according to the color arrangement of said color filters, said sampling analog switches each outputting a different voltage which is specific to said color associated with said sampling analog switch such that all of said colors capable of being displayed in said columns will be displayed with high color definition and substantially no color mixing, a gate circuit to which color selection signals and display pattern signals are inputted, said gate circuit thereafter outputting signals to selectively open and close one of said sampling analog switches in response to said color selection signals and said display pattern signals, and a shift register circuit to output said display pattern signals, with an output end of said shift register being connected to said gate circuit.

* * * * *